US006264150B1

(12) United States Patent
Kolenchuk

(10) Patent No.: US 6,264,150 B1
(45) Date of Patent: Jul. 24, 2001

(54) MOUSE AND FOREARM SUPPORT ASSEMBLY

(76) Inventor: Mark Kolenchuk, 5814 63rd. Avenue, Olds, Alberta (CA), T4H 1V3

( * ) Notice: Subject to any disclaimer, the term of this patent is extended or adjusted under 35 U.S.C. 154(b) by 0 days.

(21) Appl. No.: 09/378,908

(22) Filed: Aug. 20, 1999

(51) Int. Cl.[7] ..... A47C 7/54

(52) U.S. Cl. ..... 248/118; 248/918

(58) Field of Search ..... 400/715; 248/118, 248/118.1, 346.01, 918, 118.5; 297/227, 411.35, 411.23, 411.26, 155, 160, 161, 162

(56) References Cited

U.S. PATENT DOCUMENTS

| | | | | |
|---|---|---|---|---|
| 3,206,249 | * | 9/1965 | Gateley | 297/411.23 |
| 4,203,624 | * | 5/1980 | Hopkins | 297/162 |
| 4,795,209 | * | 1/1989 | Quinlan, Jr. et al. | 297/155 |
| 4,913,393 | * | 4/1990 | Wood | 248/118 |
| 4,996,977 | * | 3/1991 | Tiedeken | 248/118 |
| 5,281,001 | | 1/1994 | Bergsten et al. | 297/411.24 |
| 5,320,313 | | 6/1994 | Crowe | 248/231.61 |
| 5,355,811 | | 10/1994 | Brewer | 108/43 |
| 5,462,247 | * | 10/1995 | Aldrich | 248/118 |
| 5,490,710 | * | 2/1996 | Dearing et al. | 297/162 |
| 5,593,128 | | 1/1997 | Odom et al. | 248/346.01 |
| 5,636,822 | | 6/1997 | Hendershot et al. | 248/346.01 |
| 5,653,499 | | 8/1997 | Goodall | 297/170 |
| 5,700,053 | * | 12/1997 | Downing | 297/411.23 |
| 5,727,759 | | 3/1998 | Christensen | 248/118 |
| 5,752,683 | * | 5/1998 | Novis et al. | 248/118 |
| 5,779,211 | | 7/1998 | Bird | 248/346.01 |
| 5,833,180 | | 11/1998 | Baranowski | 248/118 |
| 5,848,773 | | 12/1998 | Bourassa | 248/298.1 |
| 5,876,002 | | 3/1999 | White et al. | 248/118 |
| 5,931,536 | * | 8/1999 | Wu | 297/411.35 |
| 6,074,012 | * | 6/2000 | Wu | 297/411.26 |

* cited by examiner

*Primary Examiner*—Ramon O. Ramirez
*Assistant Examiner*—Jon A Szumny
(74) *Attorney, Agent, or Firm*—John Russell Uren

(57) ABSTRACT

A mouse and forearm support assembly to support the forearm of a user while the user is resting comfortably in an armchair and which allows the use of a mouse operatively connected to a computer while the forearm of the user is supported by the support assembly. The assembly comprises a top member to allow the forearm to be rested comfortably thereon and with space enough at one end for the mouse to be moved throughout its appropriate movement. A support member is adjustably connected to the top member and extends downwardly to contact the armchair and prevent movement of the top member from a generally horizontal position. The top member is secured to an armrest of the armchair by straps and the support member is secured to the top member by bolts which may be loosened to allow movement of the support member or tightened to prevent such movement.

12 Claims, 5 Drawing Sheets

MOUSE AND FOREARM SUPPORT ASSEMBLY

This invention relates to a mouse and forearm support assembly and, more particularly, to a mouse and forearm support assembly which is easily connected to and mounted on an armchair.

BACKGROUND OF THE INVENTION

The use of a mouse in computer use is, of course, prevalent in present day life. Virtually every computer user uses a mouse, the great majority of them being movable by the hand on a flat surface to direct a cursor to a desired location on the computer screen. The use of a mouse, however, together with the keyboard of the computer cause unusual stress and loading on the body of the user, much of which has given rise to "ergonomics"; that is, the correct operating position for a user when using a computer keyboard and mouse for long periods of time in order to alleviate and avoid the unnatural and unnecessary stress on the body of the computer user.

Various prior art apparatuses have been disclosed for assisting in the comfort and use of mouses. U.S. Pat. No. 5,833,680 (Baranowski) teaches a forearm rest with a mouse support which attaches to a desk and is rotatable relative to the desk. U.S. Pat. No. 5,876,062 (White et al) teaches a forearm and mouse support which also attaches to a desk and is adjustable relative to the desk. U.S. Pat. No. 5,727,759 (Christensen) teaches a forearm and mouse support which is attached to the center pedestal of a typical office chair. U.S. Pat. No. 5,653,499 (Goodall) teaches a forearm and keyboard support which is likewise attached to the frame of a typical office chair. U.S. Pat. No. 5,779,211 (Bird) teaches a mouse pad which attaches to the leg of a user. U.S. Pat. No. 5,593,128 (Odom et al) teaches a work surface used as a mouse support which is positioned on the lap of a user. U.S. Pat. No. 5,355,811 (Brewer) teaches a mouse support which attaches to the leg of a user. U.S. Pat. No. 5,636,822 (Hendershot et al) teaches a mouse support which is attached to a desk and which may also hold a keyboard. U.S. Pat. No. 5,320,313 (Crowe) teaches a support for a joystick which is attached to a desk. U.S. Pat. No. 5,281,001 (Bergsten et al) teaches a forearm support attachable to a desk and adjustable relative thereto. U.S. Pat. No. 5,848,773 (Bourassa) teaches a mouse pad support pedestal which is mounted to an arm of a chair and which is movable relative to the chair. All of these prior art devices suffer from various disadvantages.

It is comfortable for a user to sit in an armchair in a natural position and have a mouse available to him without excessive movement of the body. Generally, a user may have a keyboard readily available for operation by both hands. When the mouse is required to be moved, however, it is necessary to make an additional and inefficient movement with one's arm to move the forearm from the keyboard to the mouse, grasp the mouse, move the mouse as required and return the hand to the keyboard. If one is simply searching the internet, for example, mouse operation may be the principal forearm movement. If one is sitting in an armchair, and the mouse is located on a desk, it is uncomfortable for extended use.

SUMMARY OF THE INVENTION

According to one aspect of the invention, there is provided a mouse and forearm support assembly comprising a top member operable to be attached to the armrest of an armchair, a bottom support member movable relative to said top member, at least one first securing member connected between said top member and being operable to connect said top member to said armrest, second securing members connected between said top member and said support member to allow said bottom support member to move relative to said top member when said second securing members are in a first position and to prevent such movement when said second securing members are in a second position.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
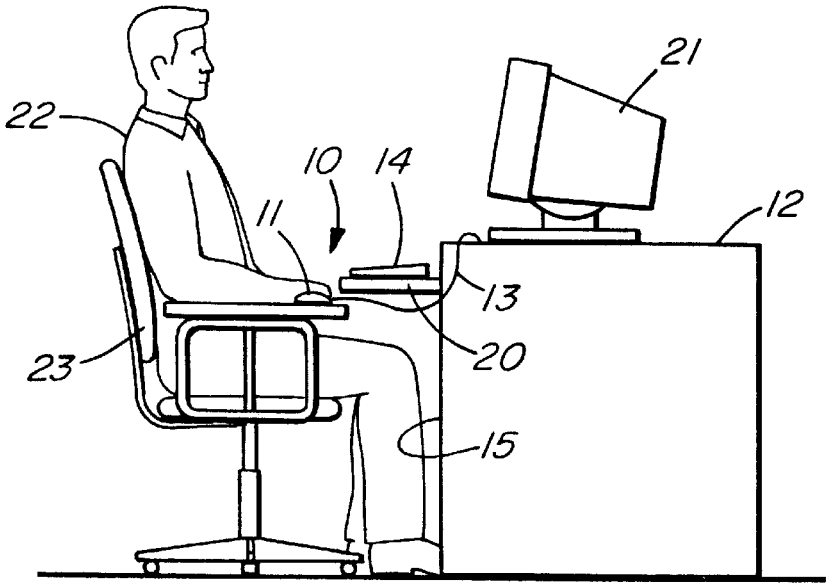
FIG. 1 is a diagrammatic side view of a user using the mouse and forearm support assembly according to one aspect of the invention.

Referring now to the drawings, a mouse and forearm support assembly according to the invention is generally illustrated at 10 in FIG. 1. The mouse 11 is connected directly to the personal computer 12 by a conductive line or cord 13 as is known. A keypad 14 is positioned on an extendible support member 20 of a desk 15 also as is known. A monitor 21 is located so as to viewed by a user 22.

The user 22 is comfortably seated in an armchair 23. Typically, access to the keypad 14 for many operations is not required particularly when viewing pages situated on the internet during "web surfing" or otherwise using minimal keypad input. The mouse 11, therefore, may be removed from the extendible support member 20 of the desk 15 and positioned on the mouse and forearm support assembly 10 as illustrated and as will be described.

Figure 2A:
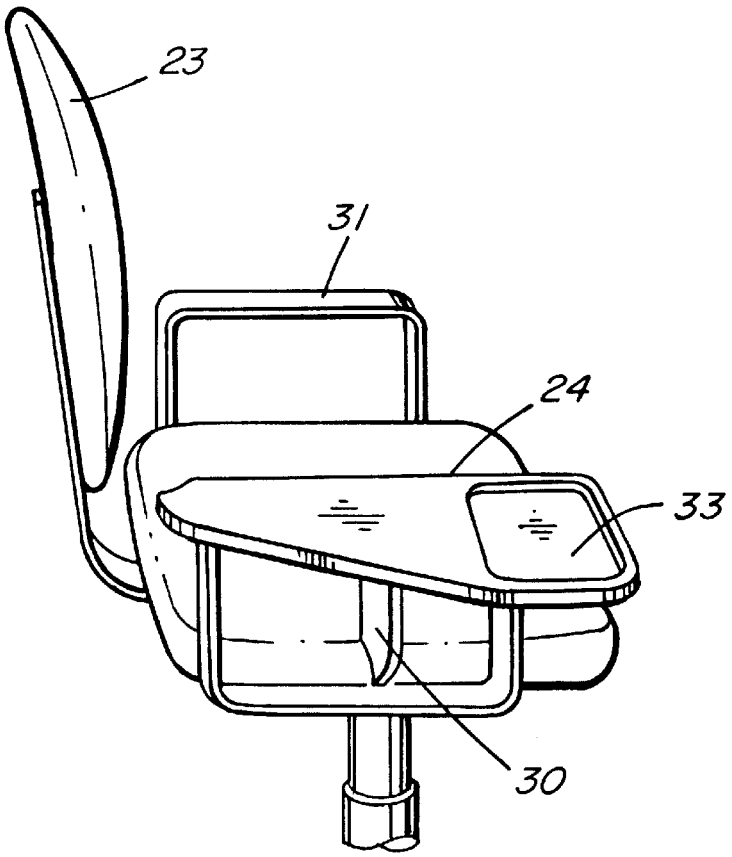
FIG. 2A is an enlarged side diagrammatic isometric view of the mouse and forearm support assembly according to the invention and particularly illustrating the assembly attached to the arm of an armchair.

The mouse and forearm support assembly 10 comprises two principal members, namely the top member 24 and the support member 30 (FIG. 2A). Top member 24 is positioned on the appropriate armrest 31 of armchair 23 depending upon whether the user 22 is right or left handed. Top member 24 has a recess 33 into which the mouse 11 is placed during use. The recess 33 is of a size sufficient to allow full movement of the mouse 11 during operating conditions.

Figure 2B:
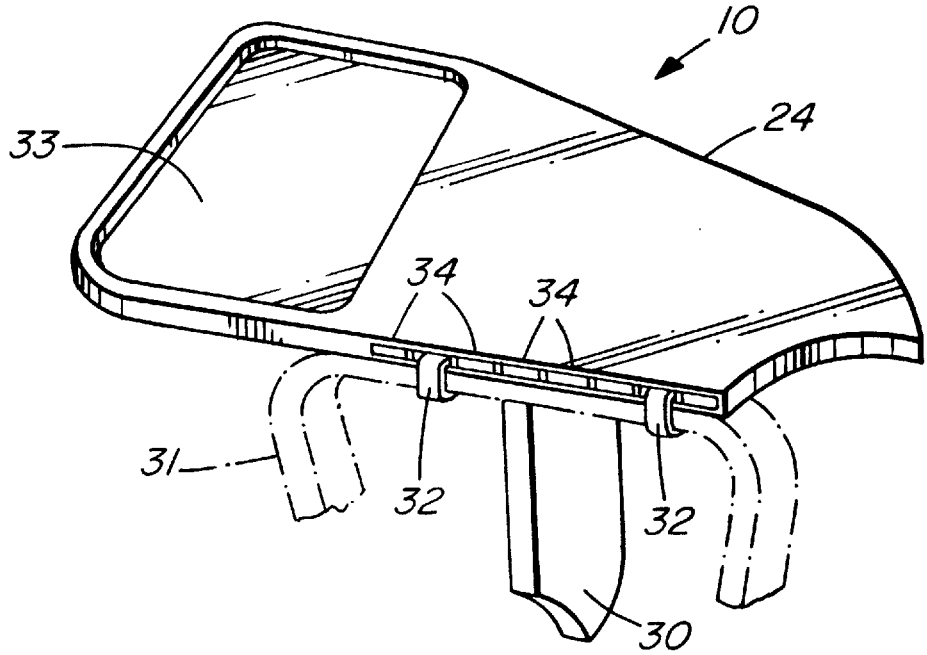
FIG. 2B is an enlarged side diagrammatic isometric view of the mouse and forearm support assembly similar to FIG. 2A but taken from the side opposite of FIG. 2A.
Figure 4A:
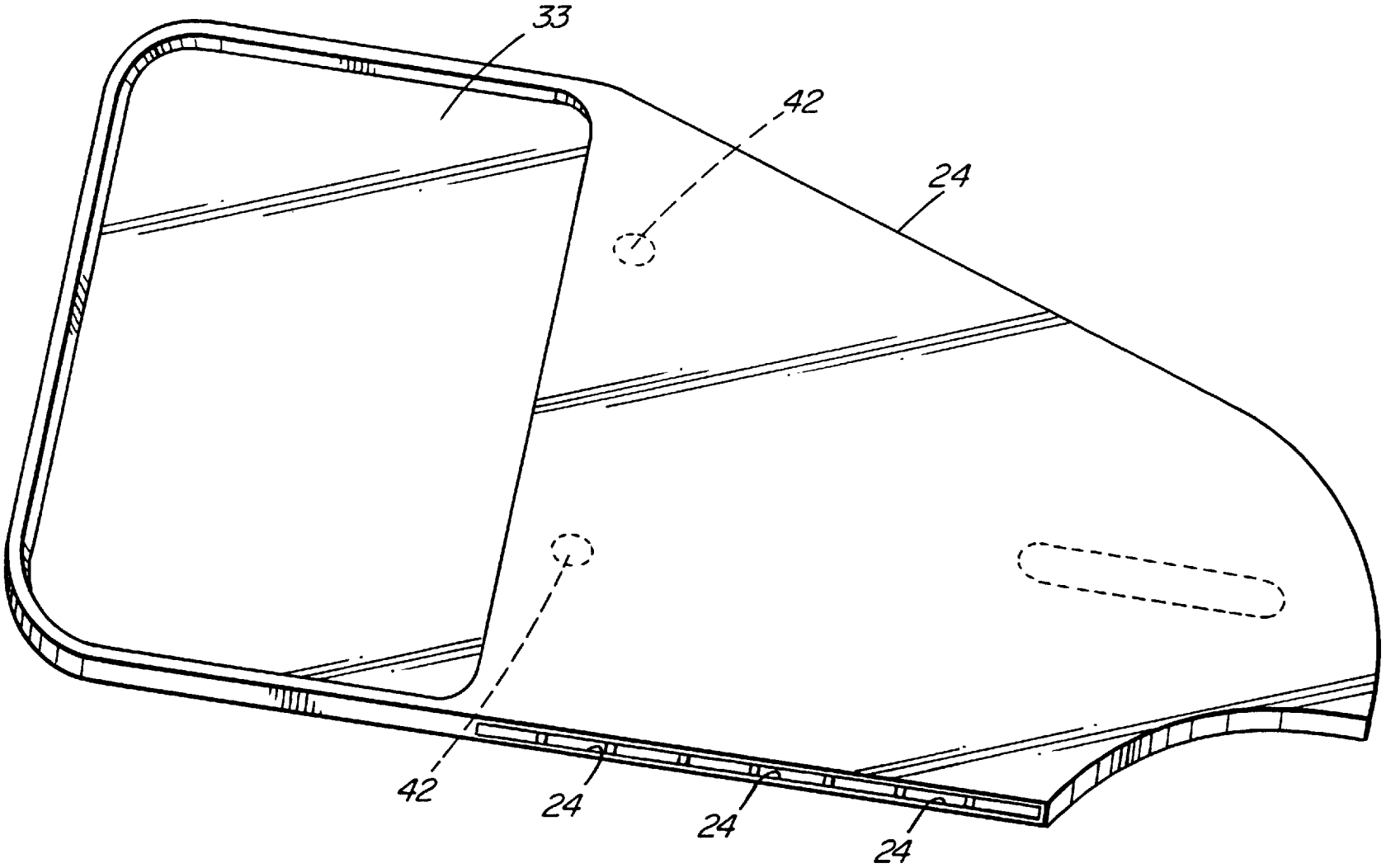
FIG. 4A is an enlarged plan diagrammatic view of the top member of the mouse and forearm assembly according to the invention.
Figure 4B:
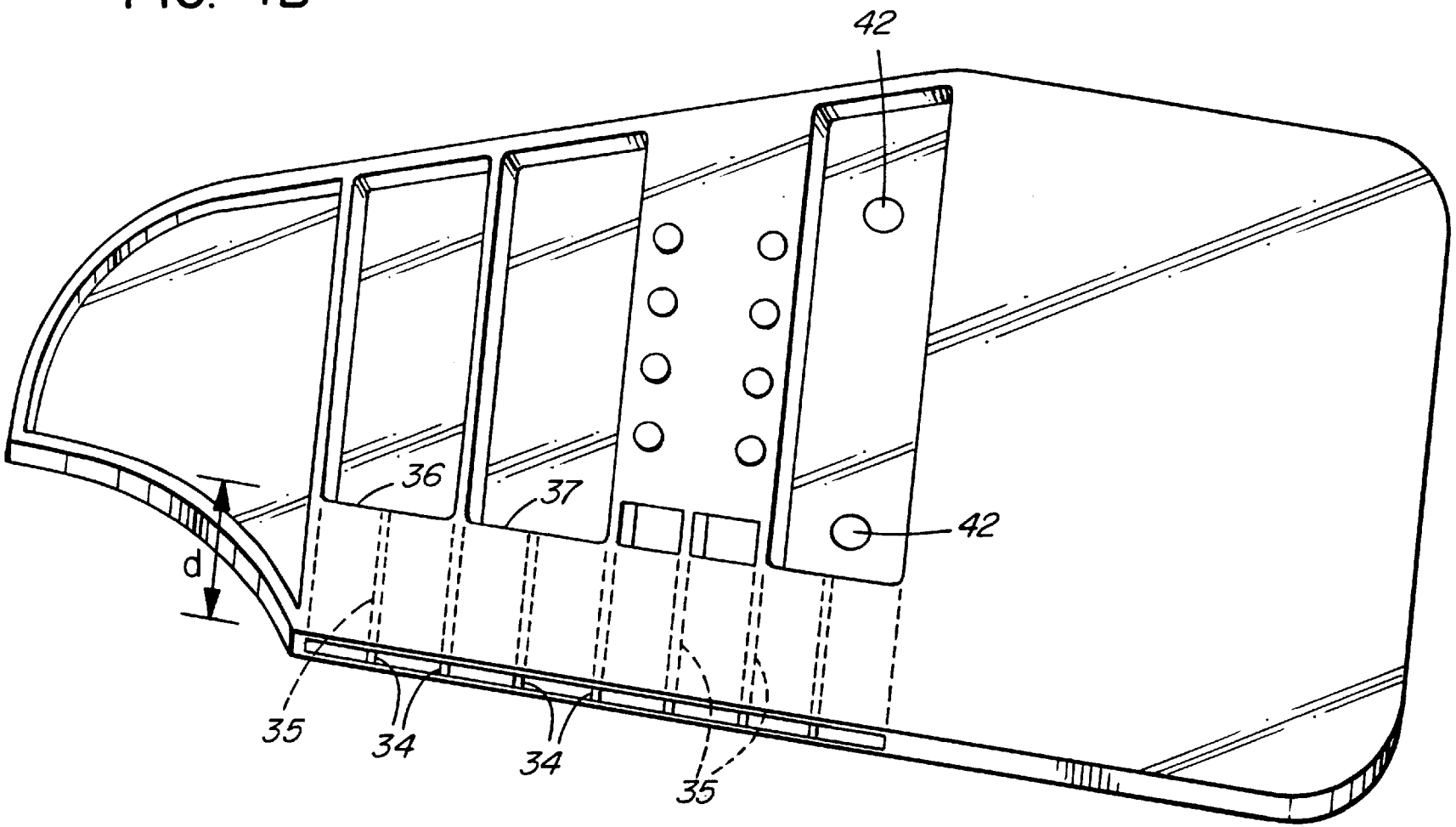
FIG. 4B is an enlarged bottom diagrammatic view of the top member of the mouse and forearm assembly similar to FIG. 4A.
Figure 5:
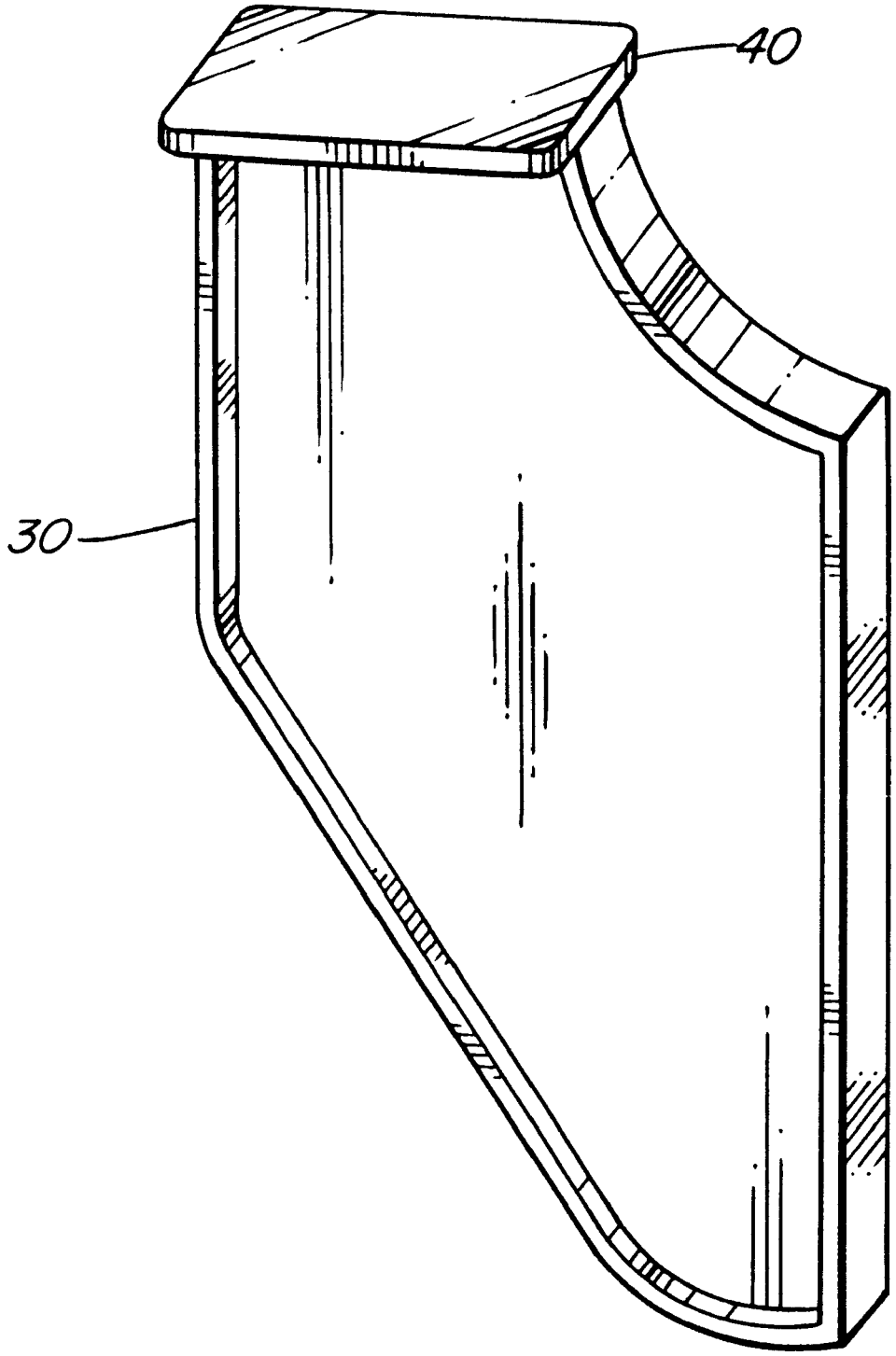
FIG. 5 is an enlarged diagrammatic isometric view of the support member or support pedestal used to reinforce the mouse and forearm assembly according to the invention in its operating position.

A plurality of holes 34 (FIG. 2B) are provided in the top member 24 of the mouse and forearm assembly 10. These holes 34 form passageways 35 (best seen in FIG. 4B) and are provided to allow a plurality of straps 32 (FIG. 2B) to extend around the armrest 31 thereby to securely attach the top member 24 to the armrest 31. The distance "d" (FIG. 4B) is conveniently approximately the width of the typical armrest 31. Two bottom recesses 36, 37 allow the straps 32 to be extended if the armrest 31 is of a greater width than usual without interfering with the top member 24.

Figure 3:
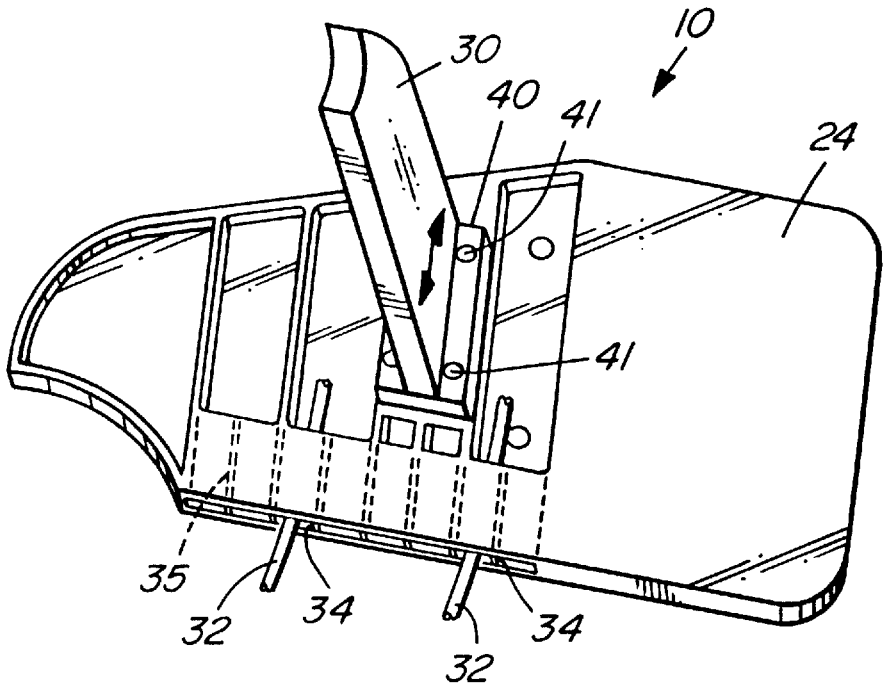
FIG. 3 is an enlarged bottom diagrammatic view of the mouse and forearm assembly similar to that of FIGS. 2A and 2B.

Support member 30, best seen assembled in FIG. 3, is adjustably mounted to the bottom surface of top member 24. Support member 24 has a flange 40 connected securely thereto. Flange 40 is slidably mounted with backwards and forwards movement being possible within an area defined on its outside longitudinal path by bolts 41. When the bolts 41 are loosened, the support member 30 may be moved as is indicated in either direction until the proper location is reached when the support member 30 abuts the seat portion of the armchair 23. When the bolts 41 are tightened, the heads of the bolts 41 will securely hold the support member 30 in its desired position wherein the top member 24 is generally horizontal.

OPERATION

In operation, the user 22 will initially position the top member 24 of the mouse and forearm support assembly 10 on the proper armrest 31 of armchair 23. If the user 22 is right handed, generally the right handed armrest 31 would be chosen. The user 22 will move the top member 24 relative to armrest 31 until its position is comfortable for the user 22 in armchair 23. The user 22 will then insert the straps 32 through the proper holes 34 of the top member 34 and tighten them appropriately around the armrest 31 to securely hold the top member 34 to the armrest 31.

The flange 40 and support member 30 will then be slidably moved under the heads of loosened bolts 41 until the support member 30 reaches contact with, generally, the seat area of armchair 23 as seen most clearly in FIG. 2A. In this position, the top member 24 should generally be in a horizontal position. The bolts 41 are then tightened and the assembly of the mouse and forearm support assembly 10 to the armchair 23 is completed.

The user 22 will then be in a comfortable position within armchair 23 as particularly illustrated in FIG. 1. The mouse 11 will be placed in the recess 33 where it is moved according to the desired position of the cursor controlled thereby on the screen of the monitor 21. Of course, if keypad manipulation is required, the user 22 may lean forwardly in order to make the appropriate keypad entry.

Provision is also provided in the top member 24 for a wrist support if desired. Two (2) holes 42 (FIGS. 4A and 4B) are provided. A raised portion (not illustrated) is then conveniently attached to the upper surface of top member 24 and securely attached by bolts which screw into the bolt holes 42.

Many modifications will readily occur to those skilled in the art to which the invention relates and the specific embodiments described should be taken as illustrative of the invention only and not as limiting its scope as defined in accordance with the accompanying claims.

I claim:

1. A mouse and forearm support assembly comprising a top member operable to be attached to an armrest of an armchair, said top member having a continuous surface and being defined by an armrest portion and a mouse support portion at the distant end of said top surface, a bottom support member movable relative to said top member, at least one first securing member connected between through said top member and being operable to connect said top member to said armrest, second securing members connected between said top member and said support member to allow said bottom support member to move relative to said top member when said second securing members are in a first position and to prevent such movement when said second securing member are in a second position, said mouse support portion being substantially flat.

2. The mouse and forearm support assembly as in claim 1 wherein said top member has at least one hole therethrough, said first securing member passing through said at least one hole.

3. The mouse and forearm support assembly as in claim 2 wherein said bottom support member has a flange movable relative to said top member.

4. The mouse and forearm support assembly as in claim 3 wherein said second securing members are bolts, said bolts defining a first tightened position of said support member when said bolts are tightened on said flange and said bolts defining a second loosened position of said support member when said bolts are loosened on said flange.

5. The mouse and forearm support assembly as in claim 1 wherein said first securing member is at least one strap.

6. The mouse and forearm assembly as in claim 5 wherein said top member has an upper surface and a mouse recess located on said upper surface.

7. The mouse and forearm assembly as in claim 6 wherein said at least one hole in said top member extends through a passageway in said top member for approximately the length of said armrest portion.

8. The mouse and forearm assembly as in claim 7 wherein said straps number two (2).

9. The mouse and forearm assembly as in claim 8 wherein said bolts number two (2).

10. The mouse and forearm assembly as in claim 6 and further comprising a wrist support removably attachable to said top member.

11. The mouse and forearm assembly as in claim 10 wherein said top member has a lower surface and wherein a second recess is provided in said lower surface adjacent the end of said passageway.

12. The mouse and forearm assembly as in claim 11 wherein said top member has a generally tapered configuration when viewed in plan.

* * * * *